United States Patent [19]

Pfeffer

[11] Patent Number: 4,890,762

[45] Date of Patent: Jan. 2, 1990

[54] WATER HEATER WITH DAM DRAPED OVER FLANGE

[75] Inventor: John D. Pfeffer, Brookfield, Wis.

[73] Assignee: A. O. Smith Corporation, Milwaukee, Wis.

[21] Appl. No.: 293,815

[22] Filed: Jan. 5, 1989

[51] Int. Cl.[4] ..... B65D 90/02

[52] U.S. Cl. ..... 220/444; 126/361; 126/373

[58] Field of Search ..... 126/361, 362, 373; 220/444, 445, 429; 413/343

[56] References Cited

U.S. PATENT DOCUMENTS

| | | | |
|---|---|---|---|
| 2,698,007 | 12/1954 | Tegler | 126/361 |
| 3,253,731 | 5/1966 | Fink et al. . | |
| 3,265,784 | 8/1966 | Jacobs | 220/444 |
| 3,362,560 | 1/1968 | Burrus et al. | 220/444 |
| 3,512,323 | 5/1970 | Hupfer | 220/444 |
| 4,372,028 | 2/1983 | Clark et al. . | |
| 4,447,377 | 5/1984 | Denton . | |
| 4,477,399 | 10/1984 | Tilton . | |
| 4,527,543 | 7/1985 | Denton . | |
| 4,628,184 | 12/1986 | West . | |
| 4,632,792 | 12/1986 | Clark . | |
| 4,736,509 | 4/1988 | Nelson . | |
| 4,744,488 | 5/1988 | Nelson . | |
| 4,790,290 | 12/1988 | Chevalier et al. . | |

*Primary Examiner*—Jimmy G. Foster

*Attorney, Agent, or Firm*—Andrus, Sceales, Starke & Sawall

[57] ABSTRACT

A water heater includes a lower skirt ring (10) supporting and spacing an inner storage tank (2) above a support surface (10*a*), a flange (44) extending radially outwardly from the sidewall (42) of the lower skirt ring, an outer jacket (12) around the inner storage tank and spaced outwardly therefrom to define an annular cavity space (22) therebetween and extending downwardly past the flange, and a seal provided by fiberglass (46) secured by a band (48) to the inner storage tank above the skirt ring and drapped over and around the edge (50) of the flange to form a dam between the flange and the outer jacket sealing the annular space. The dam prevents leakage of liquid therepast during foaming insulation.

2 Claims, 2 Drawing Sheets

WATER HEATER WITH DAM DRAPED OVER FLANGE

BACKGROUND AND SUMMARY

The invention relates to insulated fluid storage units, including hot water heaters.

Hot water heaters for domestic and other applications include an inner storage tank having an associated heating unit for heating water in the tank. The tank is enclosed with suitable insulation to retain the heat and minimize the necessity for frequent reheating. An outer asthetically pleasing jacket or shell is provided to enclose the insulation.

A highly satisfactory insulating material is expandable foamed insulation such as expanding foamed polyurethane. The insulation is applied in a fluid state into the annular cavity space between the inner storage tank and the outer jacket and foams and expands to produce a rigid and closely adhereing insulating enclosure about the inner tank.

Gas water heaters are provided with a burner aligned with the bottom of the storage tank. A skirt ring supports and spaces the tank above a support surface or base and defines a firing chamber. Polyurethane produces toxic fumes when burned, and hence must be protected from the temperature and flame of the heating unit. Various isolation sealing dams have been devised to deal with this problem, such as an inflatable donut bag, Clark et al U.S. Pat. No. 4,372,028, Tilton U.S. Pat. No. 4,477,399, a fiberglass collar, Pfeffer U.S. Pat. No. 4,749,532, Nelson U.S. Pat. No. 4,736,509, and an envelope bag, Denton U.S. Pat. Nos. 4,447,377, 4,527,543.

The present invention provides an improved dam which is simple and cost effective in manufacture.

BRIEF DESCRIPTION OF THE DRAWINGS

Prior Art

Present Invention

Figure 2:
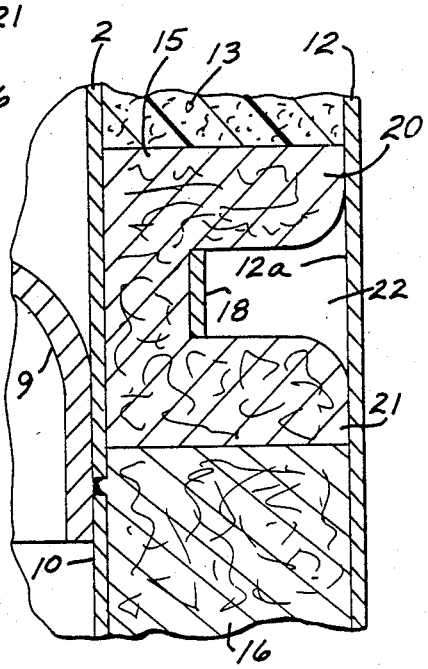
FIG. 2 PRIOR ART
FIG. 2 is an enlarged view of a portion of FIG. 1.
Figure 3:
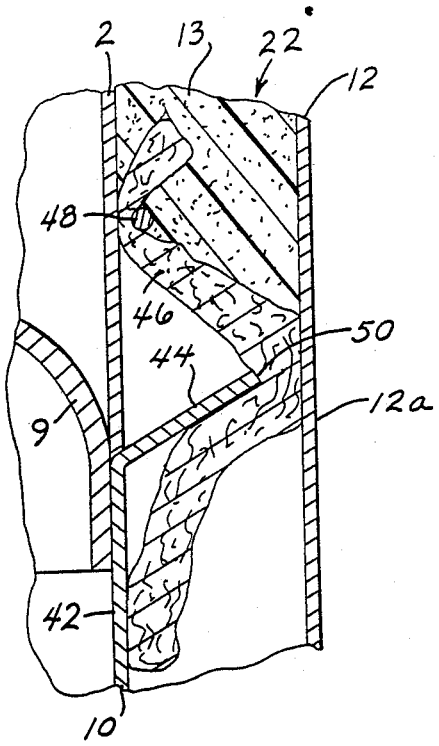

FIG. 3 is a view like FIG. 2 and shows the present invention.

DETAILED DESCRIPTION

Prior Art

Figure 1:
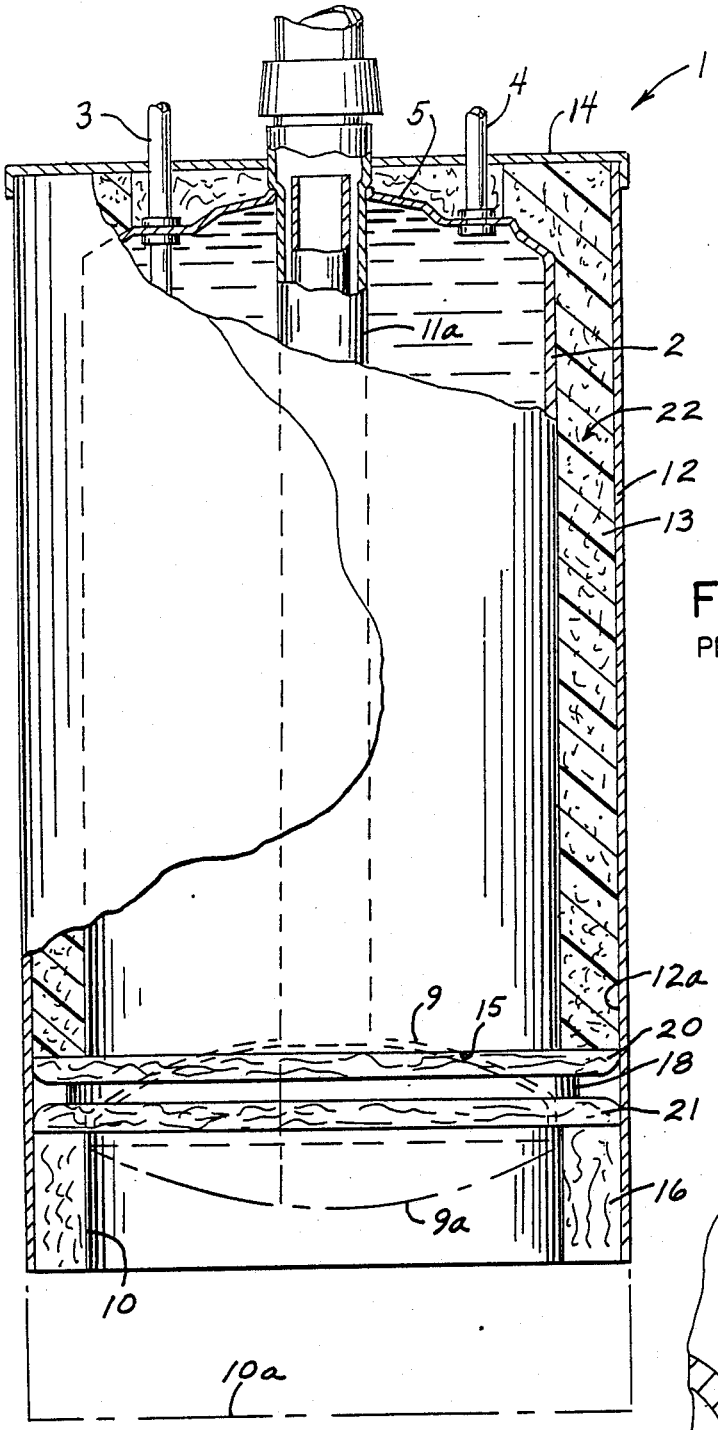
FIG. 1 PRIOR ART
FIG. 1 is a side elevation view of a hot water heater, partially broken away, known in the prior art.

FIGS. 1 and 2 show a hot water heater 1 known in the prior art, for example as shown in Pfeffer U.S. Pat. No. 4,749,532, incorporated herein by reference. FIGS. 1 and 2 use like reference numerals from the incorporated Pfeffer patent where appropriate to facilitate clarity. Inner steel storage tank 2 has water inlet and outlet connections 3 and 4 at domed top wall 5. Tank 2 may have a concave bottom wall as shown in dashed line at 9, and as shown in the incorporated Pfeffer patent, or may have a convex bottom wall as shown in dashed line at 9*a*. Lower annular steel skirt ring 10 is welded to tank 2 supports and spaces tank 2 above a support surface or base shown in dashed line at 10a. The full vertical height of skirt ring 10 is not shown, and will vary depending upon application. Skirt ring 10 defines a fire box or chamber within which is mounted the heater unit, for example as shown at 11 in FIG. 2 of the incorporated Pfeffer patent. Skirt ring 10 may rest directly on the floor and have cut-outs therein to supply combustion air to the fire box chamber, or the support surface or base 10a may have cut-outs therein and be supported above the floor by legs (not shown). Flue duct 11*a* is mounted centrally of tank 2 and extends upwardly beyond top tank wall 5 for exhausting waste gases of combustion. The inner surface of tank 2, as well as the outer surface of flue 11a, can be coated with a conventional corrosion resistant coating (not shown) such as glass or vitreous enamel.

An outer asthetically pleasing jacket or shell 12 formed of relatively thin metal is spaced outwardly of inner tank 2 to define an annular cavity space 22 therebetween. Foamed insulation 13 is introduced as a liquid into annular space 22 and hardens to form an annular insulation layer around inner storage tank 2, for which further reference may be had to the incorporated Pfeffer patent, including FIG. 7 thereof. Insulation 13 extends upwardly over top wall 5 of tank 2. A jacket cover 14 is secured to the top of jacket 12 and maintains an asthetically pleasing outer enclosure and defines an upper space which is filled with insulation 13. The lower end of insulation 13 is defined by an encircling fiberglass belt 15 providing a dam blocking passage of liquid therepast during the foaming insulation process. The dam isolates insulation 13 from the heater unit below the tank. Belt 15 is wrapped around the tank and held thereto by an encircling cinch band 18 tightened to cause the upper and lower ends 20 and 21 of belt 15 to bulge or flare outwardly to fill the gap to the inner wall 12a of outer jacket 12, to provide the noted dam. Another fiberglass belt 16 may encircle skirt ring 10 below belt 15, for further insulation.

Present Invention

FIG. 3 shows the present invention and uses like reference numerals from FIGS. 1 and 2 where appropriate to facilitate clarity. Lower skirt ring 10 supports and spaces inner storage tank 2 above support surface 10a, as in FIG. 1, and includes an annular vertical sidewall 42 extending upwardly from support surface 10a, and a flange 44 extending integrally radially outwardly and upwardly from sidewall 42. Outer jacket 12 is around and spaced outwardly from inner storage tank 2 to define annular cavity space 22 therebetween. Outer jacket 12 extends downwardly at 12a past flange 44 of skirt ring 42.

Fiberglass layer 46 is secured to tank 2 by cinch strap or wire 48 above skirt ring 10, and is draped over and around the outer edge 50 of flange 44 to form a dam sealing annular cavity space 22 as outer jacket 12 is slid downwardly over inner storage tank 2.

Flange 44 preferably extends radially outwardly and upwardly at an angle from sidewall 42 and engages sealing fiberglass 46 at the outer edge 50 of the flange. The upward extension of flange 44 aids in maintaining fiberglass 46 at outer edge 50 while outer jacket 12 is slid downwardly therepast, i.e. outer edge 50 of upwardly tilted flange 44 will tend to grip and bite into fiberglass 46 and hold same against the downward sliding of outer jacket 12. Fiberglass 46 extends from cinch band 48 radially outwardly and downwardly past flange edge 50, and then hangs freely in annular space 22. It is preferred that flange 44 extend from skirt ring 10, though such flange may be formed on inner storage tank 2.

It is recognized that various equivalents, alternatives and modifications are possible within the scope of the appended claims.

I claim:

1. An insulated fluid storage unit comprising:

an inner unit comprising an inner storage tank and a lower skirt ring supporting and spacing said inner storage tank above a support surface;

a flange extending radially outwardly from said inner unit;

an outer jacket around said inner storage tank and spaced outwardly therefrom to define an annular space therebetween, said outer jacket extending downwardly past said flange;

sealing means between said flange and said outer jacket forming a dam sealing said annular space, comprising sealing material secured to said inner storage tank above said skirt ring and draped over and around the outer edge of said flange;

foamed insulation introduced as a liquid into said annular space and hardening to form an annular insulation layer around said inner storage tank, said dam preventing leakage of said liquid therepast, wherein said outer jacket is slid downwardly over said inner storage tank, and wherein said flange of said skirt ring extends radially outwardly and upwardly at an inclinded angle from said sidewall and engages said sealing material at the outer edge of said flange and aids in maintaining said sealing material at said outer edge of said flange while said outer jacket is slid downwardly therepast.

2. An insulated fluid storage unit comprising:

an inner unit comprising an inner storage tank and a lower skirt ring supporting and spacing said inner storage tank above a support surface;

a flange extending radially outwardly from said inner unit;

an outer jacket around said inner storage tank and spaced outwardly therefrom to define an annular space therebetween, said outer jacket extending downwardly past said flange;

sealing means between said flange and said outer jacket forming a dam sealing said annular space, comprising sealing material secured to said inner storage tank above said skirt ring and draped over and around the outer edge of said flange;

foamed insulation introduced as a liquid into said annular space and hardening to form an annular insulation layer around said inner storage tank, said dam preventing leakage of said liquid therepast, wherein said sealing material is attached to said inner storage tank by a cinch band and extends radially outward from said band and then downwardly over and around said outer edge of said flange.

* * * * *